US005282264A

United States Patent [19]

Reeves et al.

[11] Patent Number: 5,282,264

[45] Date of Patent: Jan. 25, 1994

[54] APPARATUS FOR THAWING AND WARMING FLUIDS FOR INTRAVENOUS ADMINISTRATION UTILIZING HEATER AIR RECIRCULATION

[76] Inventors: William R. Reeves, Rte. 3 Box 200A, Crystal Springs, Miss. 39059; Marianne G. Defever, 175 Peachtree Dr., Jackson, Miss. 39212; Thomas G. Little, Nine Spring Hollow Dr., Crystal Springs, Miss. 39059

[21] Appl. No.: 723,599

[22] Filed: Jul. 1, 1991

[51] Int. Cl.[5] ..... A47K 10/48; F26B 3/02

[52] U.S. Cl. ..... 392/382; 219/385; 312/236

[58] Field of Search ..... 392/382, 379, 470; 604/113-114; 219/400, 385-386, 214-215; 312/236; 34/88; 165/122

[56] References Cited

U.S. PATENT DOCUMENTS

| | | | |
|---|---|---|---|
| 2,715,898 | 8/1955 | Michaelis et al. | 219/400 |
| 2,779,856 | 1/1957 | Fahner | 392/379 |
| 3,038,986 | 6/1962 | Molitor | 219/400 |
| 3,338,233 | 8/1967 | Grosholz et al. | 392/470 |
| 3,480,015 | 11/1969 | Gonzalez | 392/470 |
| 3,628,447 | 12/1971 | Levenback | 219/400 |
| 3,683,155 | 8/1972 | Loofbourow | 219/400 |
| 3,962,962 | 6/1976 | Anderson | 312/236 |
| 4,038,968 | 8/1977 | Rovell | 219/400 |
| 4,089,322 | 5/1978 | Guibert | 312/236 |
| 4,206,556 | 6/1980 | Sabo et al. | 34/88 |
| 4,309,592 | 1/1982 | Le Boeuf | 219/506 |
| 4,523,078 | 6/1985 | Lehmann | 219/214 |
| 4,678,460 | 7/1987 | Rosner | 604/113 |
| 4,707,587 | 11/1987 | Greenblatt | 219/506 |
| 4,801,777 | 1/1989 | Auerbach | 604/114 |
| 4,874,033 | 10/1989 | Chatelain et al. | 165/32 |

FOREIGN PATENT DOCUMENTS

| | | | |
|---|---|---|---|
| 91/17641 | 11/1991 | PCT Int'l Appl. | 392/470 |
| 2014583 | 8/1979 | United Kingdom . | |
| 2177300 | 1/1987 | United Kingdom | 392/382 |

*Primary Examiner*—Bruce A. Reynolds
*Assistant Examiner*—John A. Jeffery
*Attorney, Agent, or Firm*—William D. Stokes

[57] ABSTRACT

A device for thawing and warming solutions and biological fluids intended for perfusions or intravenous administration contained in sealed bags comprising a cabinet, tray mounted at the top of the cabinet for holding the bags to be thawed and/or warmed, air channels, forming a raised rim around the tray cover and communicating with the interior of the cabinet, a plurality of apertures horizontally disposed in the air channels and above the tray substantially surrounding the tray and communicating with the interior of the air channels. Air heating and impeller, a temperature sensing device, and controller device mounted in the cabinet; a plenum communicating with the air heating and impeller device for receiving the heated air, outlets in the plenum disposed in such manner as to discharge the heated air over the tray containing the bags and be taken in through the apertures in the air channel for recirculation.

10 Claims, 3 Drawing Sheets

APPARATUS FOR THAWING AND WARMING FLUIDS FOR INTRAVENOUS ADMINISTRATION UTILIZING HEATER AIR RECIRCULATION

The invention relates to a device and method for thawing frozen solutions and biological fluids and warming such fluids to temperatures prescribed for perfusions or intravenous administration. The invention is particularly concerned with an improved device and method for thawing frozen fluids intended for intravenous administration, warming the fluids to the prescribed temperature for administration and maintaining the fluids at the prescribed temperature until use without damage to the solution or biological fluid.

BACKGROUND OF THE INVENTION

One of the aggravating problems in hospitals and medical clinics today is the management of thousands of bags of solutions and biological fluids, including blood and blood products necessary for perfusions or intravenous administration. In all instances prior to perfusions or intravenous administration, the solution or fluid must be raised to a temperature compatible with body fluids of the mammal in which the fluid is to be administered. In the case of frozen fluids, the fluid must be thawed and then raised to the desired temperature. As it is well known, the numerous types of fluids used today vary greatly in composition. Heretofore each different type of solution or fluid had to be handled in accordance with the specific type and composition. By way of example, some frozen fluids cannot be thawed efficiently without damage. Some biological fluids, notably blood, have heretofore required complex means for warming to a useful temperature without irreparable damage to the product. Methods heretofore used and presently used in some facilities for thawing frozen fluids include simply thawing the bags at ambient temperatures. In such instances, the bags collect condensation from the humidity in the room which condenses on the cold bags resulting in puddles of water. In addition, the bags thus thawed collect dust and other contaminants which adhere to the wet bags bringing about the real possibility of serious injury to the patient. Hot water baths are also used, i.e. dumping the bags of frozen fluids in a sink filled with hot water. As may be appreciated, such method of thawing or warming suffers from such disadvantages as inability to control the temperature, creation of hot spots resulting in decomposition and contamination from bacteria and other pathogens in the water from the sink drains. Moreover, such technique precludes the use of the sink for other purposes. Microwave ovens have also been used to thaw frozen fluids, notwithstanding the fact that most manufacturers advise against such use. Even with careful monitoring by a professional technician, the integrity of the plastic bags and the contents can readily be compromised by the uneven heating, spot overheating, condensation on the bags and the unknown effects of microwave radiation.

Other devices and methods of thawing biological fluids and/or raising the temperature of such fluids for intravenous administration have been proposed, for example, as disclosed in U.S. Pat. No. 4,707,587. Devices of the type described require the blood be removed from its storage container and circulated through the device to be warmed by circulating air. There are known devices such as described in U.S. Pat. No. 4,309,592 which utilize electrical heating plates. The use of such type of a device requires special storage containers for the fluids being warmed. Numerous other devices have heretofore been utilized for thawing and/or warming liquids for intravenous administration are disclosed in for example, U.S. Pat. Nos. 4,678,460 to Rosner; 4,874,033 to Chatelain et. al.; 4,801,777 to Auerbach; and 4,523,078 to Lehmann.

SUMMARY OF THE INVENTION

In accordance with the invention there is provided a simple, practical and relatively inexpensive device for thawing and warming fluids for perfusions or intravenous administration. The device of the invention may be readily employed to simultaneously thaw or warm single or multiple bags of different types of solutions or biological fluids in a controlled manner without damage to any of the solutions or fluids. The device may be easily constructed in such manner as to be readily movable from place to place for convenience. The inventive device assures the thawing or warming of solutions and fluids without contamination or any deleterious effect on the biological fluids as often experienced by the devices heretofore known in the art.

The apparatus of the invention comprises means for heating and circulating air in a controlled manner over a bag or bags of solution or biological fluid to thaw or warm same. The invention includes novel means for effectively causing the heated air to be distributed uniformly and evenly at a predetermined temperature over the bag, bags or pouches holding the liquid to be thawed or warmed thereby achieving uniform thawing and/or warming of the liquid, notwithstanding different shapes and types of containers and/or types of solution or biological fluid.

DESCRIPTION OF THE INVENTION

Figure 1:
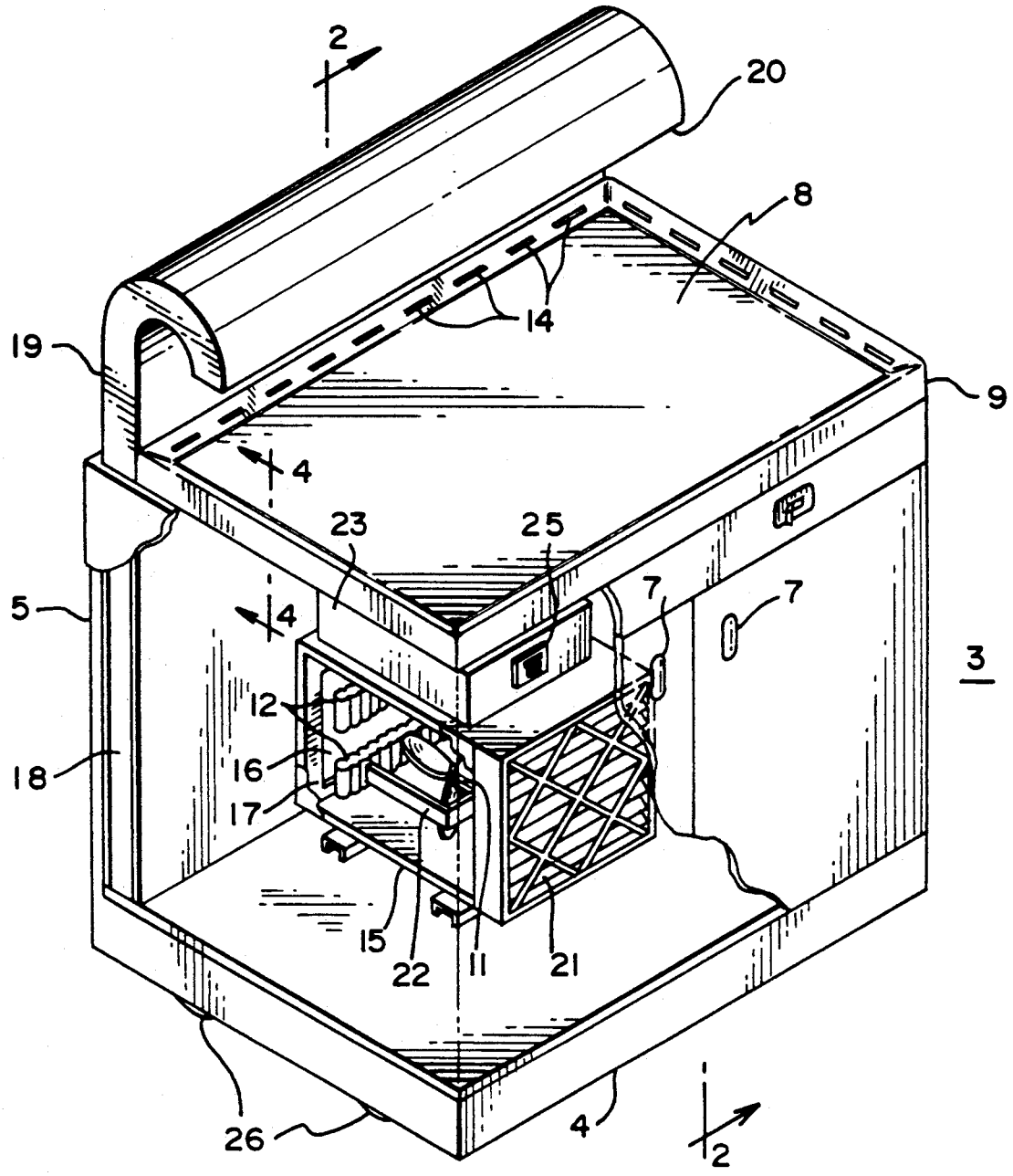
FIG. 1 is a perspective view of the liquid thawing and warming apparatus of the invention.
Figure 2:
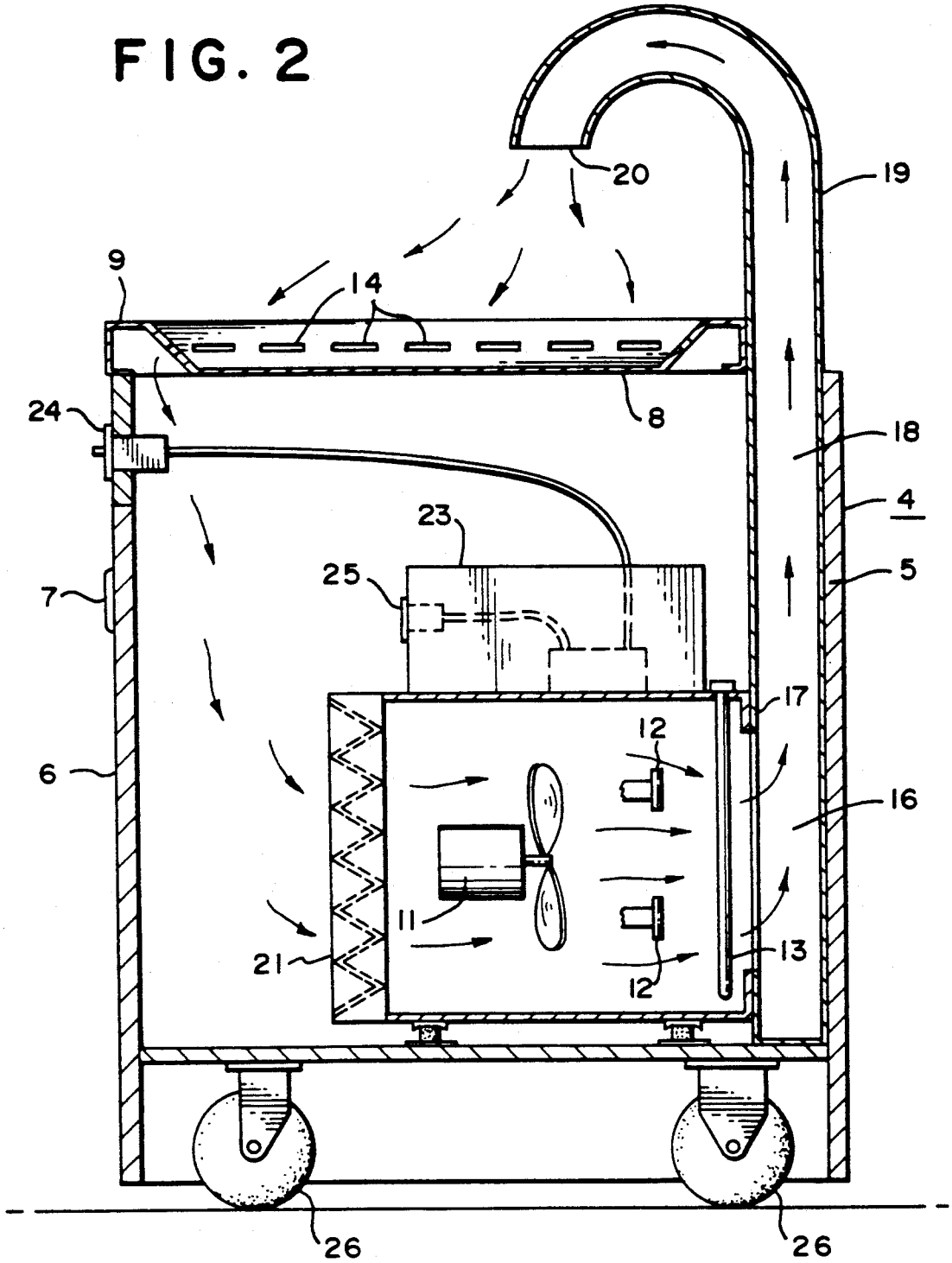
FIG. 2 is a cross section taken along line 2—2 of FIG. 1 and illustrating by arrow the air flow pattern of the apparatus in operation.
Figure 4:
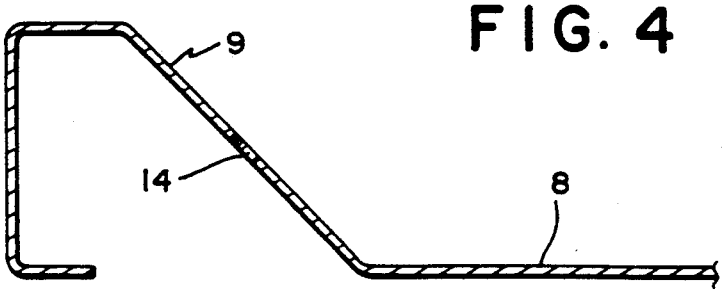
FIG. 4 is a cross section of the air intake channel of the device of the invention.

Referring to the drawings in which like parts have the same numerals, and in particular to FIGS. 1, 2 and 4, the liquid thawing-warming device 3 comprises a cabinet 4 having a back 5, sides (not shown), and doors 6. Handle means 7 are provided to effect opening of doors 6 to the interior of cabinet member 4. Tray member 8 and air intake channel means 9 form the top of cabinet 4. Air channel means 9 is integrally and continuously formed with or mounted on tray 8 forming the elevated edge around the tray member. In the illustrated embodiment, air intake channel 9 comprises a plurality of horizontally disposed slots 14 above tray member 8 and extending through the intake channel member 9 and communicating with the interior of cabinet 4. While in the illustrated embodiment, the air intake means of the apparatus is depicted as horizontally disposed cut substantially in a median line interior of channel 9 the air intake means may advantageously be aperatures of other shapes than slots.

In a preferred embodiment, cabinet 4 is provided with casters or wheels 26 to provide convenient mobility for the device of the invention. The cabinet of the invention may be of any convenient self-insulating building material such as wood or plastic. In the preferred embodiment, plastic laminated wood is used. Tray member 8 may be of any heat conducting material such as metal or high impact heat conducting plastic. In the preferred embodiment, tray member 8 and air intake channel means 9 are formed as a single integral unit of stainless steel. It will be appreciated that the bags or pouches may be placed on single or multiple level racks above tray member 8 without effecting the safe and efficient thawing and warming achieved by the invention.

Mounted within cabinet 4 is a housing 15 for the elements of the invention effecting air cleansing, air circulation, air warming, temperature sensing means and direction. In the illustrated embodiment of FIG. 1, housing 15 is shown as mounted on shock absorbing skids (not numbered). Referring specifically to FIGS. 1 and 2, the back wall 17 of housing 15 is sealingly connected with a wall of air plenum 18. An opening 16 in the wall side 17 of housing 15 communicates directly with the interior of air plenum 18. As shown in the illustrated embodiment, air plenum 18 extends upwardly, adjacent to, and interiorly of back wall 5 of cabinet 4. Plenum 18 is constructed to extend above tray member 8 and air intake channel 9. The extending end 19 of plenum 18 is formed so as to curve back over the top of tray 8. Air flowing through plenum 18 is discharged through outlet port 20 downwardly toward the surface of tray 8. The outlet port 20 in the illustrated embodiment extends the full width of plenum 18. It is important that the air outlet port of plenum 18 be constructed, arranged and positioned in such manner that the discharged air is distributed evenly over the surface of tray member 8. It will be appreciated by those skilled in the art that the outlet port of the plenum could be constructed in such manner as to terminate in a nozzle means to accomplish even distribution of the warmed air over the bags of liquids.

An air filter 21 is mounted on the front end of housing 15 in such manner that air being circulated will flow through the filter. Any of the well known air filters commonly used in furnaces and air conditioning units will perform satisfactorily in the operation of the inventive device, however, in the preferred embodiment a non-woven cotton plus polyester, pleated type filter having about ten pleats per linear foot is used.

Heating means 12 are mounted in brackets 22 in housing 15 in such manner that air being passed through the housing will flow around and be heated the heating means before passing into plenum 18 through opening 16. Satisfactory operation of the inventive device may be obtained by the use of any type of resistive heating element that will adequately distribute heat to the air being circulated over and around the heating elements. In the preferred embodiment, nickel-plated, stainless steel finned heating strips are used. These elements achieve a maximum temperature of 950° F. An impeller fan unit 11 is mounted in housing 15 between filter 21 and heating means 12 by any conventional mounting means (not shown). While it is not critical to the operation of the invention, it has been found that an air movement of about 300 cubic feet per minute is quite satisfactory. A temperature sensor 13 is mounted in housing 15 between heating means 12 and the opening 16 into plenum 18 in order to sense and communicate the temperature of the air flowing through the device to the controller, described hereinafter.

Figure 3:
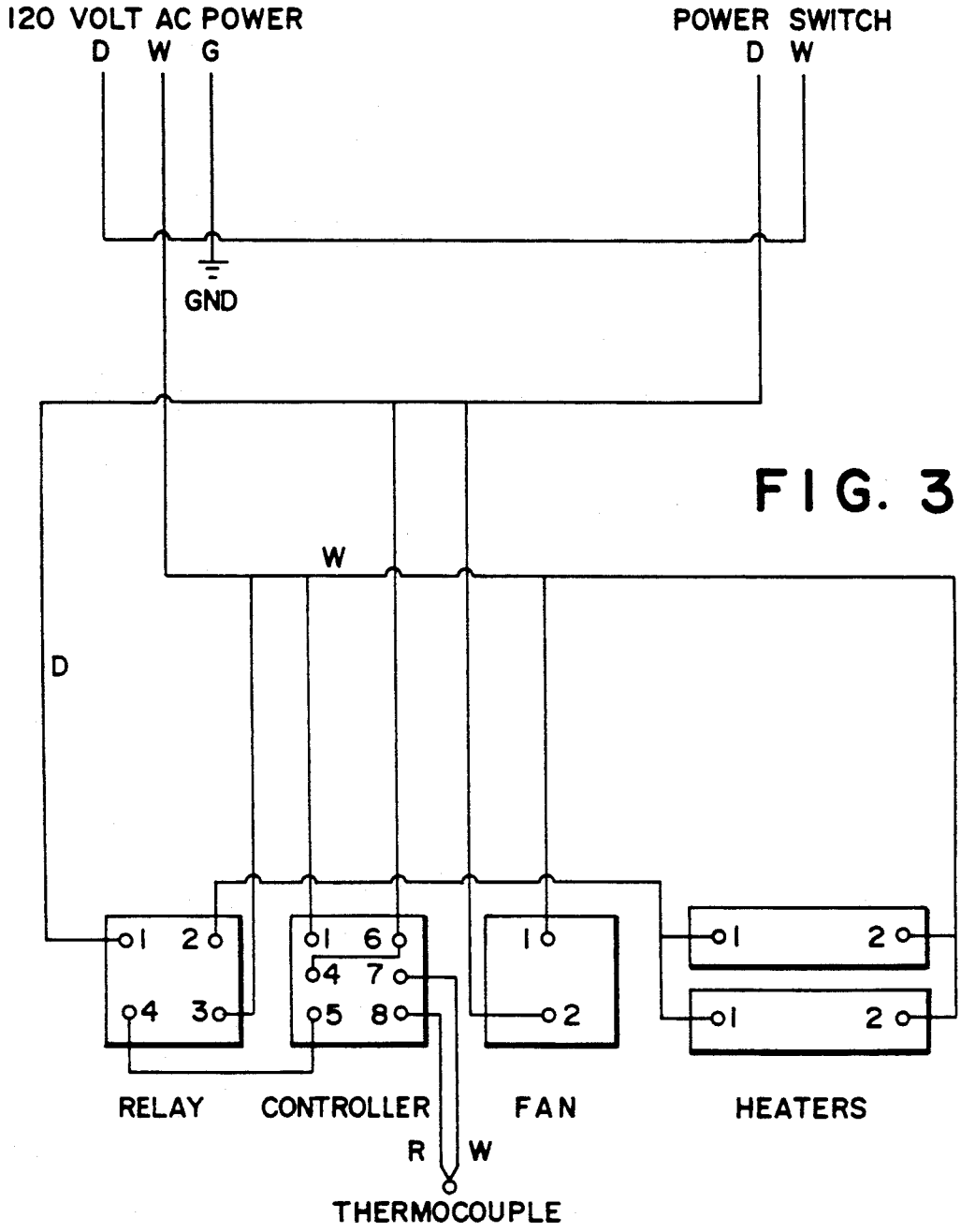
FIG. 3 is a schematic diagram of the electrical circuitry of the apparatus of the invention.

Control circuitry means for operating the device are illustrated schematically in FIGS. 2 and 3 as operatively connected with the heating-circulating-sensing elements mounted in housing 15. In the drawings, the control means are shown mounted in a box 23. The power switch 24 is shown mounted on the front 6 of cabinet 4. Digital control means 25 are operatively connected to the heating unit 12, temperature sensor 13 and fan unit 11 through a relay means as illustrated in the circuitry of FIG. 3. A single loop MCU based direct digital controller has been found to provide sure and excellent results in the operation of the inventive device. The simple and practical operation of the device may be readily observed in FIGS. 2 and 3. The power for operation is obtained from any 110 V.A.C. duplex power receptacle. When the power switch is turned to the on position, current flows to the relay that controls temperature controller 25. Thermostat 13 senses the temperature within the housing and sends the information to the controller. When the temperature within housing 15, consequently the temperature of the air flowing through housing 15 during operation, falls outside of the selected temperature range, the controller allows current to flow to the heaters to increase or decrease the temperature, as the case may be, to bring the air temperature to the predetermined temperature range. When the temperature falls within the predetermined range, the thermostat in effect notifies the controller and the controller thereupon shuts off the heating elements. The fan unit is also controlled by the controller. The fan runs continuously. In the event of a fan malfunction, the fan will cease to operate and the controller will concomittantly shut down the entire operation. As specifically shown in FIG. 2, during operation heated air is continuously circulated in the pathways shown by the arrows. Air impelled out of outlet port 20 from plenum chamber 18 is drawn over the bags or pouches of fluid disposed on tray 8 and thence into cabinet 4 through the slots 14 and air intake channel 9. In cabinet 4, the air is drawn through filter 21 by means of fan 11 and impelled over and around heating unit 12 through opening 16 and into plenum 18 in a continuously circulating pattern. It will be appreciated that the bags containing the solutions or fluids to be thawed and/or heated are simply laid out on tray 8 or positioned on the tray or racks positioned above the tray if used,. The heated air passes over and around the bags in a uniform manner effecting the warming of the fluids to the necessary temperature for intravenous administration. It will be appreciated that the invention enables all areas of the bags to be uniformly warmed eliminating any destructive hot spots on the bags of fluids, condensation from the surrounding air, and air borne contaminants and dust. The greatest and most important achievement brought about by the invention is the uniformity of the heating applied to all parts of the containers for the fluid enabling uniform thawing and/or warming of the liquids to be administered.

While the invention has been described with reference to specific embodiments and modification, those skilled in the art will be able to make other substitutions for and modifications of individual parts and elements thereof without departing from the spirit and scope of the invention.

We claim:

1. Device for thawing and warming solutions and biological fluids contained in sealed bags and intended for perfusions or intravenous administration said device comprising in combination:

cabinet means;

tray means mounted on and forming the top of said cabinet;

air intake channel means around said tray and communicating with the interior of said cabinet;

a plurality of spaced apart apertures arranged around the periphery of the tray means in said air intake channel means and communicating through said air intake channel means with the interior of said cabinet;

air filter means mounted in said cabinet in such manner that substantially all of the air flowing into the cabinet from the said air intake channel means flows therethrough;

air impeller means for drawing said air through said filter means and impelling the filtered air;

air heating means disposed in the path of the impelled air;

temperature sensing means disposed downstream of the said heating means;

plenum means for receiving and directing the flow of air;

air outlet means in said plenum disposed above said tray in such manner so as to direct the flow of air downwardly onto said tray and through said plurality of spaced apart apertures in said air intake channel and recirculation;

controller means responsive to said temperature sensing means for operating said air impeller means and heating means in such a manner as to maintain a predetermined temperature for the circulating air.

2. The device of claim 1 wherein the tray means and air intake channel means are integrally formed as a unit.

3. The device of claim 2 wherein the tray and air intake channel are formed of stainless steel.

4. The device of claim 1 wherein the air filter means is a non-woven, cotton plus polyester, pleated type filter having about 10 pleats per linear foot.

5. The device of claim 1 wherein the controller means is a single loop MCU based direct digital device.

6. The device of claim 1 wherein the air impeller means is capable of moving about 300 cubic feet of air per minute.

7. The device of claim 1 wherein the plurality of apertures in the air intake channel means are horizontally disposed slots.

8. The device of claim 1 wherein the air intake channel means extends above the tray in such manner as to form a raised rim around said tray and said plurality of apertures face inwardly of the air intake channel and above said tray.

9. The device of claim 8 wherein the apertures are horizontally disposed slots.

10. The device of claim 1 wherein the heating means comprises nickel-plated, stainless steel finned electrical resistance heating strips.

* * * * *